US010074899B2

(12) United States Patent
Wu et al.

(10) Patent No.: US 10,074,899 B2
(45) Date of Patent: Sep. 11, 2018

(54) ANTENNA SYSTEM

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Yu-Yi Chu, Taipei (TW); Ya-Jyun Li, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 15/641,335

(22) Filed: Jul. 5, 2017

(65) Prior Publication Data

US 2018/0102589 A1 Apr. 12, 2018

(30) Foreign Application Priority Data

Oct. 6, 2016 (TW) ..... 105132400 A

(51) Int. Cl.

| | |
|---|---|
| ***H01Q 1/38*** | (2006.01) |
| ***H01Q 1/52*** | (2006.01) |
| ***H01Q 5/335*** | (2015.01) |
| ***H01Q 5/357*** | (2015.01) |
| ***H01Q 1/24*** | (2006.01) |
| ***H01Q 21/08*** | (2006.01) |

(52) U.S. Cl.

CPC ..... *H01Q 1/523* (2013.01); *H01Q 1/24* (2013.01); *H01Q 1/38* (2013.01); *H01Q 5/335* (2015.01); *H01Q 5/357* (2015.01); *H01Q 21/08* (2013.01)

(58) Field of Classification Search

None

See application file for complete search history.

(56) References Cited

U.S. PATENT DOCUMENTS

| | | | | |
|---|---|---|---|---|
| 2011/0274146 | A1* | 11/2011 | Huang | H01Q 1/38 375/219 |
| 2013/0257674 | A1* | 10/2013 | Li | H01Q 5/321 343/853 |
| 2014/0078010 | A1* | 3/2014 | Li | H01Q 1/243 343/729 |
| 2015/0054707 | A1* | 2/2015 | Sugimoto | H01Q 1/48 343/846 |
| 2015/0084831 | A1* | 3/2015 | Liu | H01Q 21/24 343/893 |

(Continued)

FOREIGN PATENT DOCUMENTS

| | | |
|---|---|---|
| TW | M395272 U1 | 12/2010 |
| TW | I511378 B | 12/2015 |

(Continued)

*Primary Examiner* — Trinh Dinh

(74) *Attorney, Agent, or Firm* — CKC & Partners Co., Ltd.

(57) ABSTRACT

An antenna system includes a system ground and two antenna units. The two antenna units are individually disposed on two opposite sides of the system ground and symmetrically mirrored with each other. Each antenna unit includes a circuit board, a first antenna pattern and a second antenna pattern. The first antenna pattern is disposed at one side of the circuit board. The first antenna pattern resonates to generate a first high resonant frequency. The second antenna pattern is disposed at the other side of the circuit board. The first antenna pattern resonates with part of the second antenna pattern to generate a low resonant frequency.

14 Claims, 13 Drawing Sheets

(56) References Cited

U.S. PATENT DOCUMENTS

| | | | | |
|---|---|---|---|---|
| 2015/0162659 | A1* | 6/2015 | Wong | H01Q 5/371<br>343/729 |
| 2015/0236422 | A1* | 8/2015 | You | H01Q 7/00<br>343/729 |
| 2015/0303556 | A1* | 10/2015 | Flores-Cuadras | H01Q 1/085<br>343/893 |

FOREIGN PATENT DOCUMENTS

| | | | |
|---|---|---|---|
| TW | I533505 | B | 5/2016 |
| TW | I533509 | B | 5/2016 |
| TW | 201622248 | A | 6/2016 |
| TW | I548145 | B | 9/2016 |

* cited by examiner

ANTENNA SYSTEM

RELATED APPLICATIONS

This application claims the priority benefit of Taiwan application serial no. 105132400, filed on Oct. 6, 2016. The entirety of the above-mentioned patent application is hereby incorporated by reference herein and made a part of this specification.

BACKGROUND

Technology Field

The disclosure relates to an antenna system and, more particularly, to a Multiple Input Multiple Output (MIMO) antenna system.

Description of the Related Art

Multiple Input Multiple Output (MIMO) antenna system has been widely used. Conventionally, a low-pass filter device and a coupling conductive cable in an antenna system are commonly used to reduce the correlation between a high frequency band and a low frequency band as well as reduce the isolation of each antenna. However, the structure of the antenna system may become quite large due to the low-pass filter device and the coupling conductive cable.

Nowadays, many electrical devices have a tendency towards a smaller size. It is desired to develop a miniaturized MIMO antenna system to meet product specifications. When a conventional planar inverted-F antenna (PIFA) is applied, there might have some problems such as, unideal isolation in a low resonant frequency and a too big envelope correlation coefficient (ECC). Besides, all service providers have different frequency systems, it is desired that a MIMO antenna with great isolation and a small ECC should be developed for a miniaturized device in order to receive and transmit signals in all frequency bands.

SUMMARY

According to one aspect of the present disclosure, an antenna system is provided. The antenna system includes a system ground and two antenna units. The two antenna units are individually disposed on two opposite sides of the system ground and symmetrically mirrored with each other. Each antenna unit includes a circuit board, a first antenna pattern and a second antenna pattern. The first antenna pattern is disposed at a first side of the circuit board. The first antenna pattern includes a first metal part, a second metal part, a third metal part, a first bend and a second bend. The first metal part, the second metal part and the third metal part are aligned in parallel. The first metal part is connected with one end of the second metal part via the first bend while the other end of the second metal part is connected with the third metal part via the second bend. the first antenna pattern generates a first high resonant frequency. The second pattern is disposed at a second side of the circuit board. The first antenna pattern resonates with part of the second antenna pattern to generate a low resonant frequency.

According to technologies of the present disclosure, a MIMO antenna system for a miniaturized device can be implemented, and the antenna system has a great performance on isolation and ECC for each antenna, thereby improving the quality of the wireless transmission throughput.

These and other features, aspects, and advantages of the present invention will become better understood with regard to the following description, appended claims, and accompanying drawings.

DETAILED DESCRIPTION

The following detailed descriptions are elaborated by embodiments in cooperation with drawings, but the specific embodiments described below are intended for explaining the present invention and are not limitations of the present invention. The structural descriptions should not limit the order in which they are performed. Devices that are reassembled from any elements and have equal efficacy are all within the scope of the present disclosure. In addition, the drawings are only illustrative and not drawn in accordance with their true dimensions.

Figure 1A:
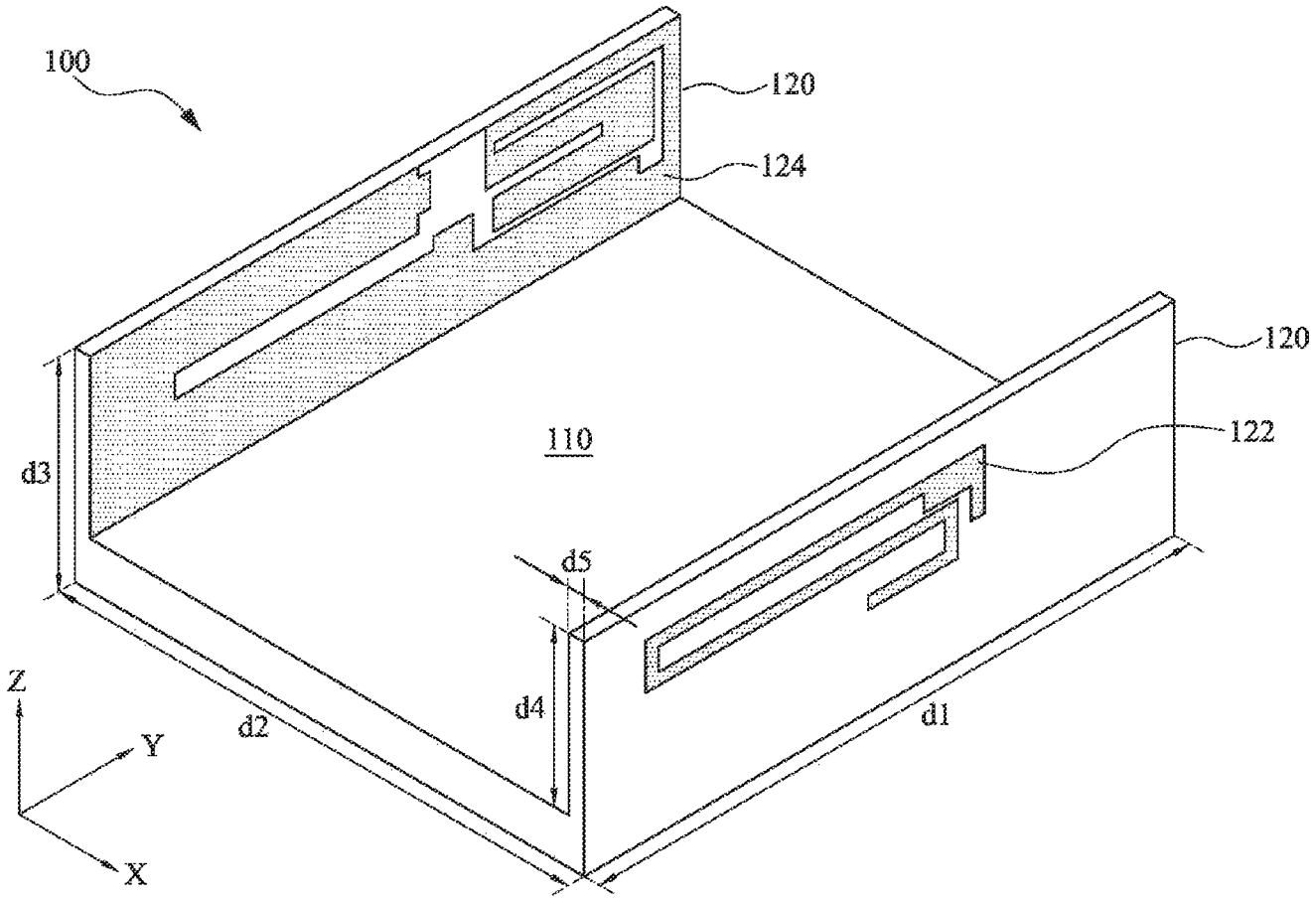
FIG. 1A is a schematic diagram of an antenna system structure according to an embodiment of the present invention.

Firstly, refer to FIG. 1A, which is a side view of a main structure of an antenna system 100 according to an embodiment of the present invention. The antenna system 100 has a dimension of d1 (L)×d2 (W)×d3 (H), for example, 75 mm×75 mm×20 mm. Thus, the antenna system 100 can be used in small sized electronic devices, such as mobile phones, watches, cameras and portable/wearable electronic devices. The antenna system 100 also can be used in any products that require antennas installed thereof for transmitting and receiving signals. The antenna system 100 uses, for example, a printed circuit board (PCB) as a substrate. The bottom side of the antenna system 100 is a single-sided PCB while the two sides perpendicular to the bottom side are double-sided PCBs. The double-sided PCBs have a dimension of d1 (L) ×d4 (W) ×d5 (H), for example, 75 mm ×15 mm ×0.8mm. A system ground 110 is disposed on the PCB of the bottom side of the antenna system 100, and two identical antenna units 120 are individually disposed on the double-sided PCBs of the two opposite sides of the antenna system 100. The antenna unit 120 may be, for example, a long term evolution (LTE) antenna.

Each antenna unit 120 uses a double-sided PCB as a substrate. A first antenna pattern 122 is installed on the outer side of the double-sided PCB while a second antenna pattern 124 is installed on the inner side of the double-sided PCB. The first antenna pattern 122 and the second antenna pattern 124 are, for example, conductive traces of copper material. The stnictures of the first antenna pattern 122 and the second antenna pattern 124 will be elaborated in FIGS. 2A and 2B.

Figure 1B:
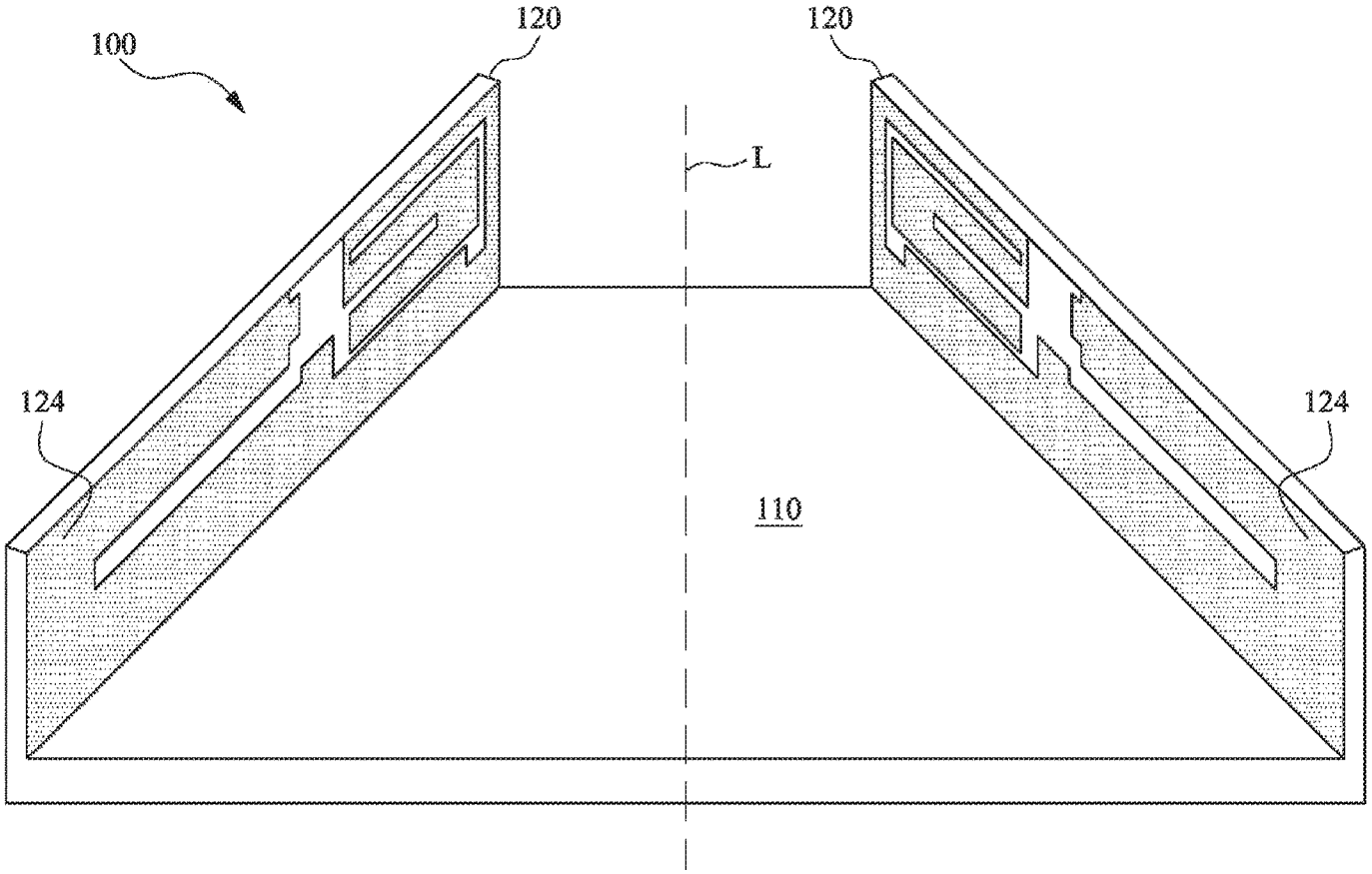
FIG. 1B is a schematic diagram of an antenna system structure according to an embodiment of the present invention.

FIG. 1B is a perspective view of the antenna system 100 according to an embodiment of the present invention. The two antenna units 120 are symmetrical with respect to a central line L and mirrored with each other. To be more specific, the first antenna patterns 122 of the antenna units 120 (on the outer of the antenna units 120) are symmetrically mirrored with each other with respect to the central line L and the second antenna patterns 124 of the antenna units 120 are symmetrically mirrored with each other with respect to the center line L, as shown in FIG. 1B.

Figure 2A:
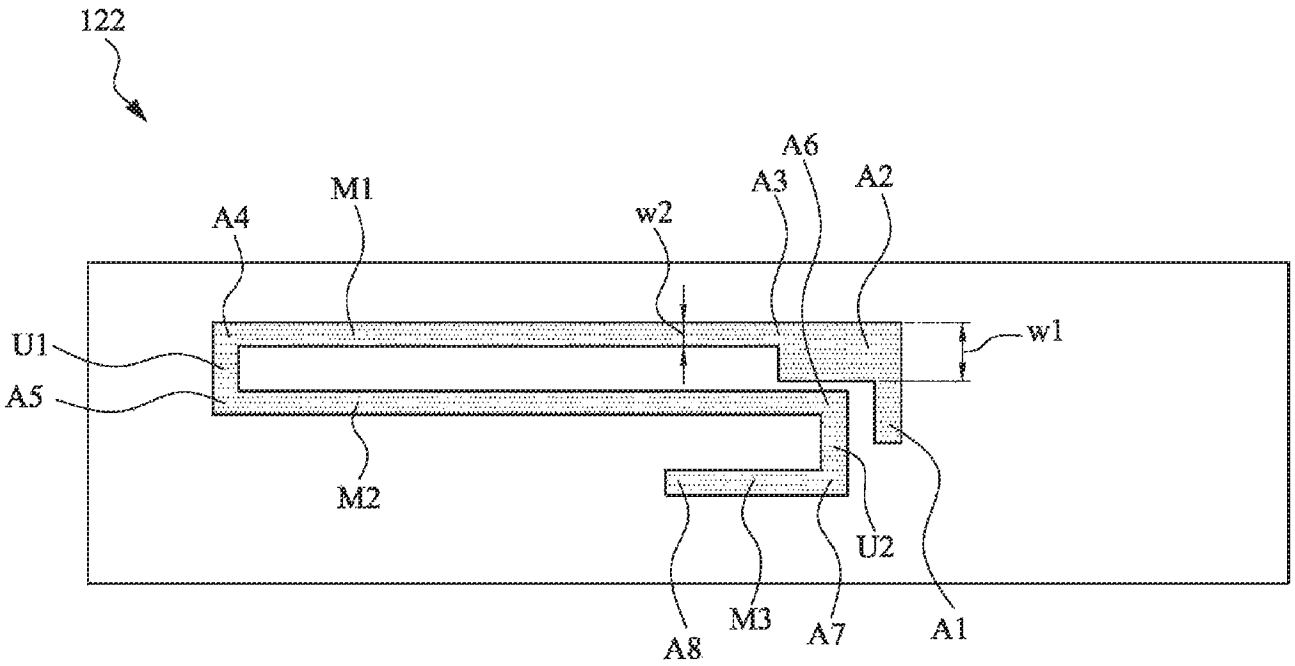
FIG. 2A is a schematic diagram of an antenna pattern according to an embodiment of the present invention.

Please refer to FIG. 2A, which is a schematic diagram of the first antenna pattern 122 according to an embodiment of the present invention. FIG. 2A shows the first antenna pattern 122 of the right antenna unit 120 of the antenna system 100 in FIG. 1. The first antenna pattern 122 of the left antenna unit 120 of the antenna system 100 is a symmetrical mirror image of FIG. 2A. Since the two antenna units 120 of the antenna system 100 have identical functions and are symmetrically mirrored, the present disclosure only takes the antenna unit 120 on one side (right side) as an example for simplicity.

In FIG. 2A, the first antenna pattern 122 is formed by segments among points A1~A8; in other words, the first antenna pattern 122 includes a first metal part M1, a second metal part M2, a third metal part, a first bend U1, a second bend U2. In the first antenna pattern 122, the first metal part M1 is between the points A2~A4: the second metal part M2 is between the points A5~A6, the third metal part M3 is between the points A7~A8; the first bend U1 is between the points A4~A5; the second bend U2 is between the points A6~A7. The first metal part M1, the second metal part M2 and the third metal part M3 are aligned in parallel. The first bend U1 and the second bend U2 are aligned in parallel. One end of the first metal part M1 is connected with one end of the second metal part M2 via the first bend U1, and the other end of the second metal part M2 is connected with one end of the third metal part M3 via the second bend U2, which forms an S-shaped antenna pattern. Besides, a width w1 of a first end of the first metal part M1 (i.e. the point A2) is wider than a width w2 of a second end of the first metal part M1 (opposite the first end, i.e. the point A3). In this embodiment, the width w1 is, for example, 3 mm while the width w2 is, for example, 1 mm.

The first end of the antenna pattern 122 has a metal extension part, i.e. the segment from the point A1 to the point A2. The metal extension part is parallel to the first bend U1 and the second bend U2. The metal extension part has a feed point, i.e. the point A1, which is intended for coupling with a signal positive of the wireless transmitting/receiving circuit (not shown) via a coaxial cable (not shown). The third metal part M3 has a ground end, i.e. the point A8, opposite the end connected with the second bend U2. The ground end is coupled to a signal negative of the wireless transmitting/receiving circuit (not shown) via a coaxial cable (not shown) and coupled to the system ground 110.

Figure 2B:
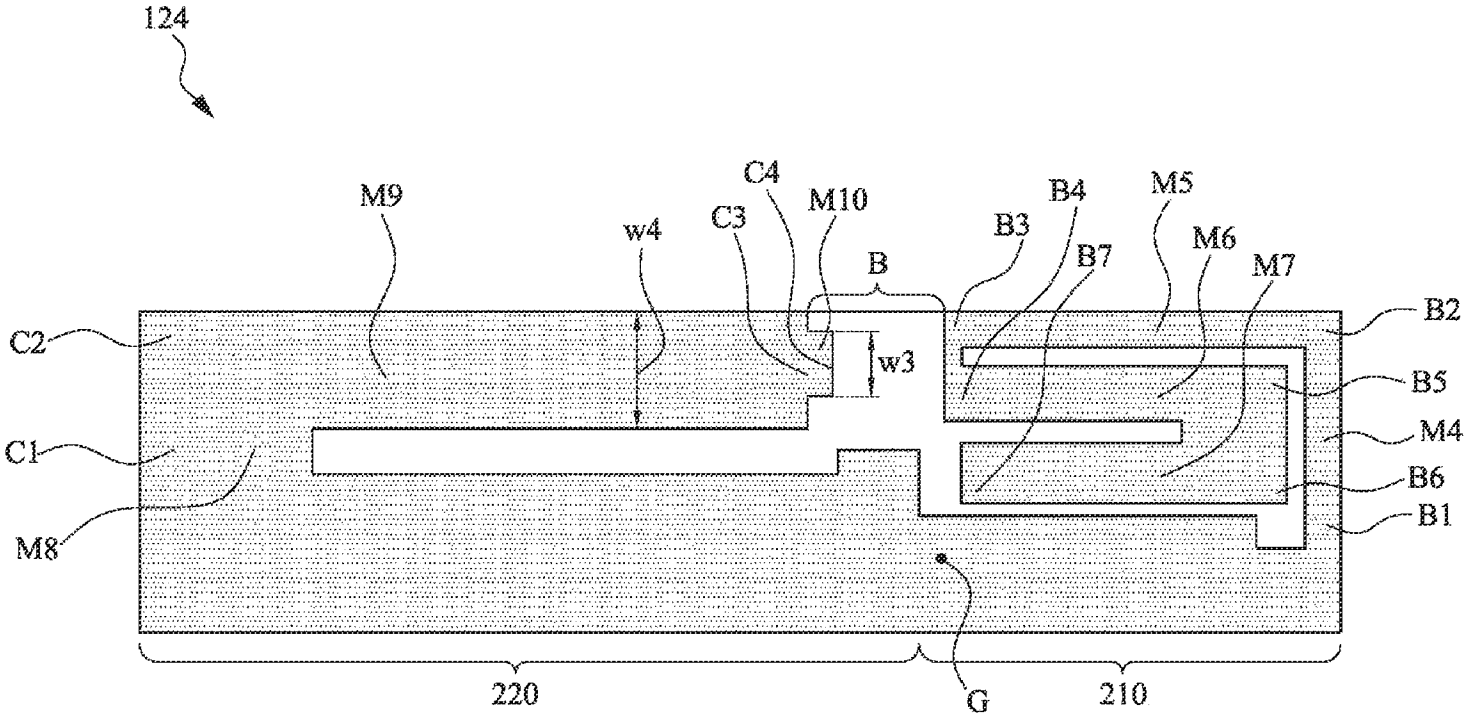
FIG. 2B is a schematic diagram of an antenna pattern according to an embodiment of the present invention.

To continue with the abovementioned embodiment, please refer to FIG. 2B. FIG. 2B shows a schematic diagram of the second antenna pattern 124 according to an embodiment of the present invention. Similar to FIG. 2A, only the right-sided antenna unit 120 of the antenna system 100 is considered herein for simplicity's sake. In FIG. 2B, the second antenna pattern 124 is formed by segments among points B1~B7 and points C1~C4. A gap B is located between the point B3 and the point C3. In this embodiment, the gap B is, for example, 9 mm.

The gap B divides the second antenna pattern 124 into a first current path 210, which is composed of the points B1~B7; and a second current path 220, which is composed of the points C1~C4. The first current path 210 includes a fourth metal part M4, a fifth metal part M5, a sixth metal part M6 and a seventh metal part M7. The fourth metal part M4 is located between the points B1~B2; the fifth metal part M5 is located between the points B2~B3; the sixth metal part is located between the points B4~B5; the seventh metal part is located between the points B6~B7.

The fourth metal part M4 is perpendicularly connected with one end of the fifth metal part M5 while the fifth metal part M5, the sixth metal part M6 and the seventh metal part M7 are aligned in parallel. The other end of the fifth metal part M5 is connected with one end of the sixth metal part M6 via a bend between the points B3-B4 while the other end of the sixth metal part M6 is connected with the seventh metal part M7 via a bend between the points B5~B6.

The second current path 220 includes the eighth metal part M8, the ninth metal part M9 and the tenth metal part M10. The eighth metal part M8 is located between the points C1~C2; the ninth metal part is located between the points C2~C3; the tenth metal part M10 is located between the points C3~C4. One end of the eighth metal part M8 is perpendicularly connected with one end of the ninth metal part M9, forming an L shape. The other end of the ninth metal part M9 is connected with the tenth metal part M10. A width w3 of the tenth metal part M10 is less than a width w4 of the ninth metal part M9. In this embodiment, the width w3 is, for example, 4 mm; and the width w4 is, for example, 7 mm.

A point G of the second antenna pattern 124 is a ground, coupled to the signal negative of the wireless transmitting/receiving circuit via a coaxial cable as well as coupled to the system ground 110. The second antenna pattern 124 works as a ground plane for the antenna unit 120. The first antenna pattern 122 resonates with the second antenna pattern 124 via the double-sided PCB to generate a resonant frequency band for transmitting and receiving signals.

Figure 3:
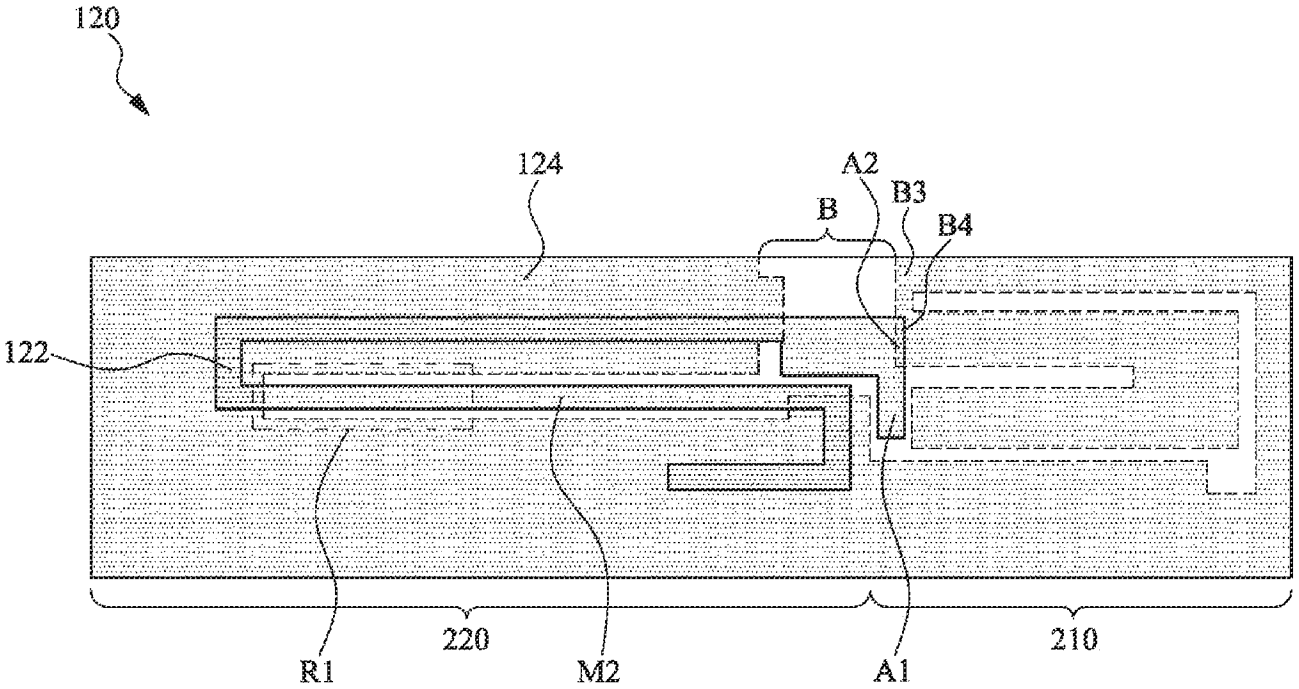
FIG. 3 is a side view of an antenna unit according to an embodiment of the present invention.

Please refer to FIG. 3, which is a side view of the antenna unit 120 according to an embodiment of the present invention. FIG. 3 is illustrated from a view of the right-sided antenna unit 120 of the antenna system 100. In FIG. 3, the first antenna pattern 122 is shown in solid lines, and the second antenna pattern 124 on the other side (the back side opposite the first antenna pattern 122) of the double sided PCB is shown in dash lines. The overlap relationship between projections of the first antenna pattern 122 and the second antenna pattern 124 in the direction perpendicular to the double-sided PCB can be seen. For example, the projection of the first end (i.e. the point A2) of the first metal part M1 and the projection of one end (i.e. the point B4) of the sixth metal part M6 have an overlap in the direction perpendicular to the doubled-sided PCB.

The first antenna pattern 122 resonates with the second antenna pattern 124 to generate a resonant frequency band, which includes a low resonant frequency and multiple high resonant frequencies. The low resonant frequency is generated by the resonance of the overlapped projections of the first antenna pattern 122 and the gap B and the first current path 210 of the second pattern antenna 124 on the back side. The width of the gap B is associated with the low resonant frequency. Thus, the low resonant frequency can be tuned by adjusting the width of the gap B. Also, by adjusting the area/coupling level of the overlapped projections of the first end (i.e. the point A2) of the first metal part M1 and one end (i.e. the point B4) of the sixth metal part M6; or by adjusting the width w1 (as shown in FIG. 2A) of the first metal part M1, the impedance matching of the low resonant frequency can be changed.

As mentioned above, the high resonant frequencies generated by the resonance of the first antenna pattern 122 and the second antenna pattern 124 may include four frequencies, such as a first high resonant frequency, a second high resonant frequency, a third high resonant frequency and a forth high resonant frequency. The first high resonant frequency is generated by the resonance of the loop of the first antenna pattern 122 itself; the second high resonant frequency is generated by, for example, the resonance of the overlapped projections of the first antenna pattern 122 and the gap B and the overlapped projections of the first antenna and the second current path 220 of the second antenna pattern 124. By adjusting the width w3 of the tenth metal part M10, the impedance matching of the second high resonant frequency can be changed.

The third high resonant frequency is generated by the resonance of the overlapped projects of the first antenna pattern 122 and the gap B on the back side and the resonance of the overlapped projections of the first antenna 122 and the first current path 210 of the second antenna pattern 124. The third high resonant frequency is about twice as much as the aforementioned low resonant frequency. The forth high resonant frequency is generated by the resonance of the overlapped projections of the first antenna pattern 122 and the second current path 220 of the second antenna pattern 124. The projection of the second metal part M2 of the first antenna pattern 122 and the projection of a slit R1 surrounded by the second current path 220 of the second antenna 124 have an overlap in the vertical direction, as shown in FIG. 3. The fourth high resonant frequency can be changed by adjusting the size of the slit R1.

Figure 4A:
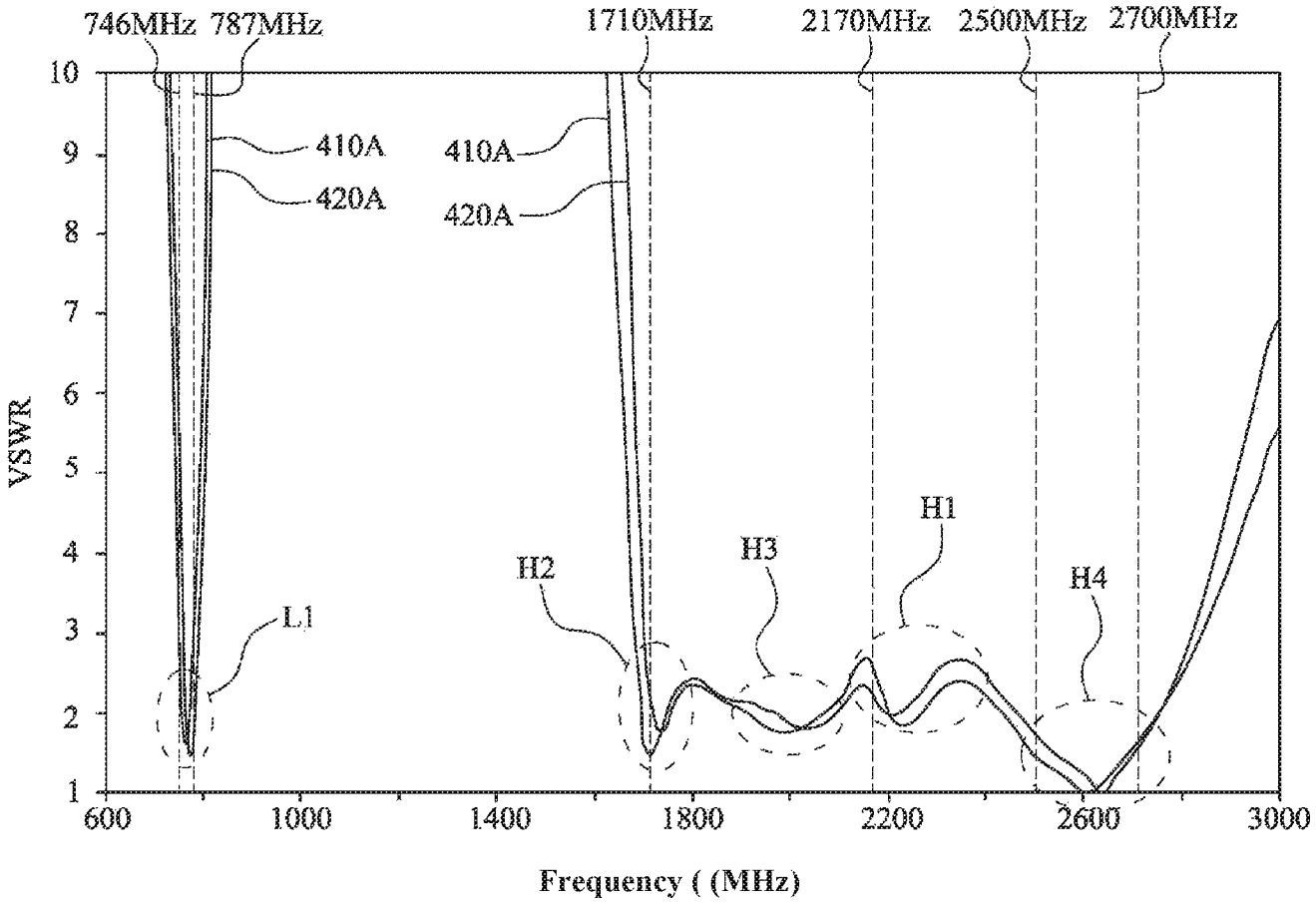
FIG. 4A is a plot of VSWR vs. Frequency for an antenna unit according to an embodiment of the present invention.

As known above, the antenna unit 120 can receive and transmit signals in different resonant frequencies. Through the resonances of the overlapped projections of multiple paths, the antenna 120 can process multiple high resonant frequencies, and have an effect of a broadband antenna, which implements a LTE multi-frequency antenna. A VSWR plot of the two antenna units 120 is shown in FIG. 4A. FIG. 4A shows a plot of VSWR vs. frequency for the two antenna units 120 according to an embodiment of the present invention.

In FIG. 4A, a curve 410A represents VSWR vs. frequency for the right-sided antenna 120 of the antenna system 100 in FIG. 1 while a curve 420A represents VSWR vs. frequency for the left-sided antenna system 100 in FIG. 1.

The VSWR of the low resonant frequency generated by the aforementioned first and second antenna patterns 122 and 124 is denoted as L1 in FIG. 4A. The VSWR of the first high resonant frequency is denoted as H1; the VSWR of the second high resonant frequency is denoted as H2; the VSWR of the third high resonant frequency is denoted as H3; the VSWR of the forth high resonant frequency is denoted as H4. As seen in FIG. 4A, the antenna unit 120 has the VSWRs of the low resonant frequency and high resonant frequencies approximating to 1, which shows low energy reflection and excellent impedance matching.

Figure 4B:
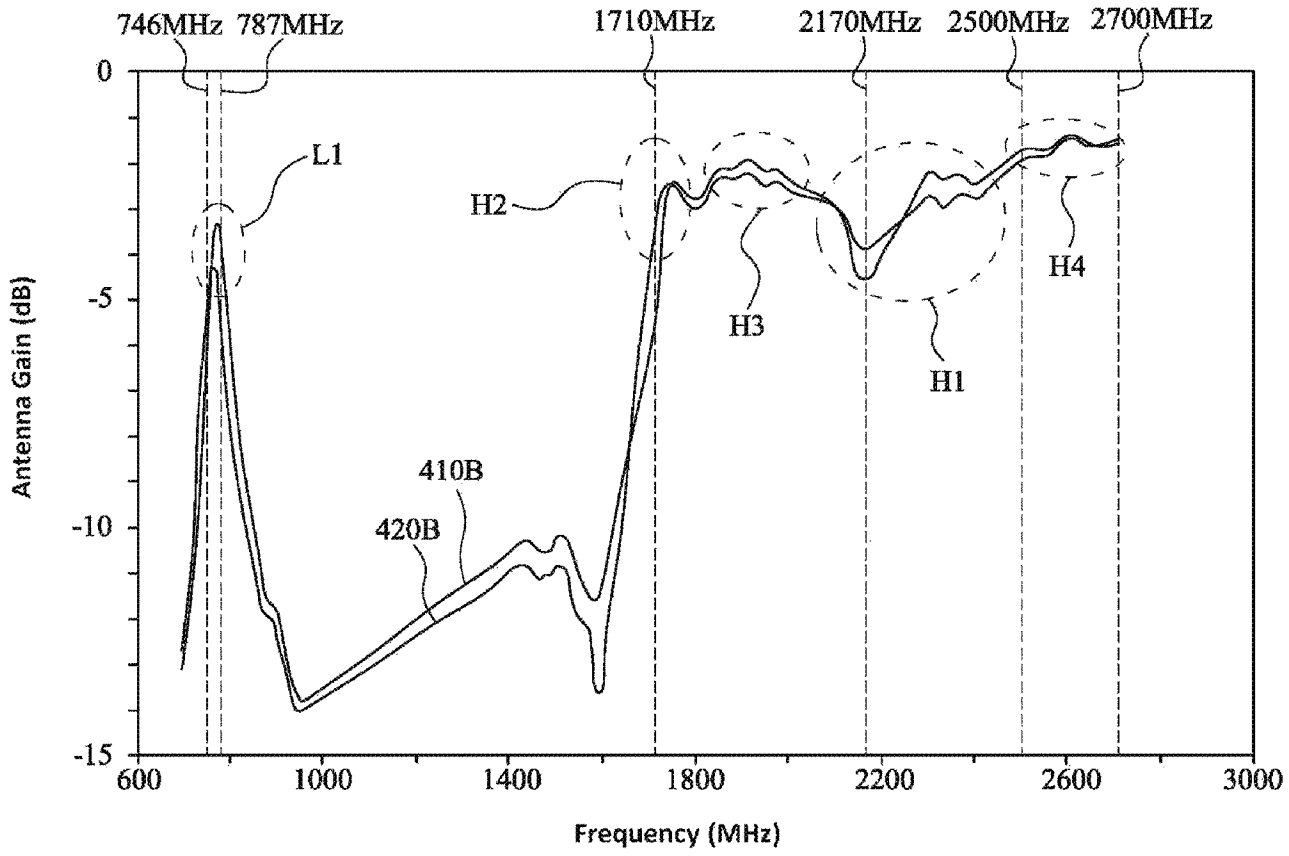
FIG. 4B is a plot of Antenna Gain vs. Frequency for an antenna unit according to an embodiment of the present invention.

FIG. 4B is a plot of antenna gain vs. frequency for the antenna unit 120 according to an embodiment of the present invention. In FIG. 4B, a curve 410B represents the antenna gain vs. frequency for the right-sided antenna unit 120 of the antenna system 100 while a curve 420B represents the antenna gain vs. frequency for the left-sided antenna unit 120 of the antenna system 100.

The antenna gain of the low resonant frequency generated by the aforementioned first and second antenna patterns 122 and 124 is denoted as L1 in FIG. 4B; the antenna gain of the first high resonant frequency is denoted as H1; the antenna gain of the second high resonant frequency is denoted as H2; the antenna gain of the third high resonant frequency is denoted as H3; the antenna gain of the forth high resonant frequency is denoted as H4. As seen in FIG. 4B, the antenna gain of the antenna unit 120 is greater than −5 dB for the low resonant frequency and is greater than −3 dB for the high resonant frequencies. Thus, the antenna gain has quite nice performance in the resonant frequency band.

Figure 5A:
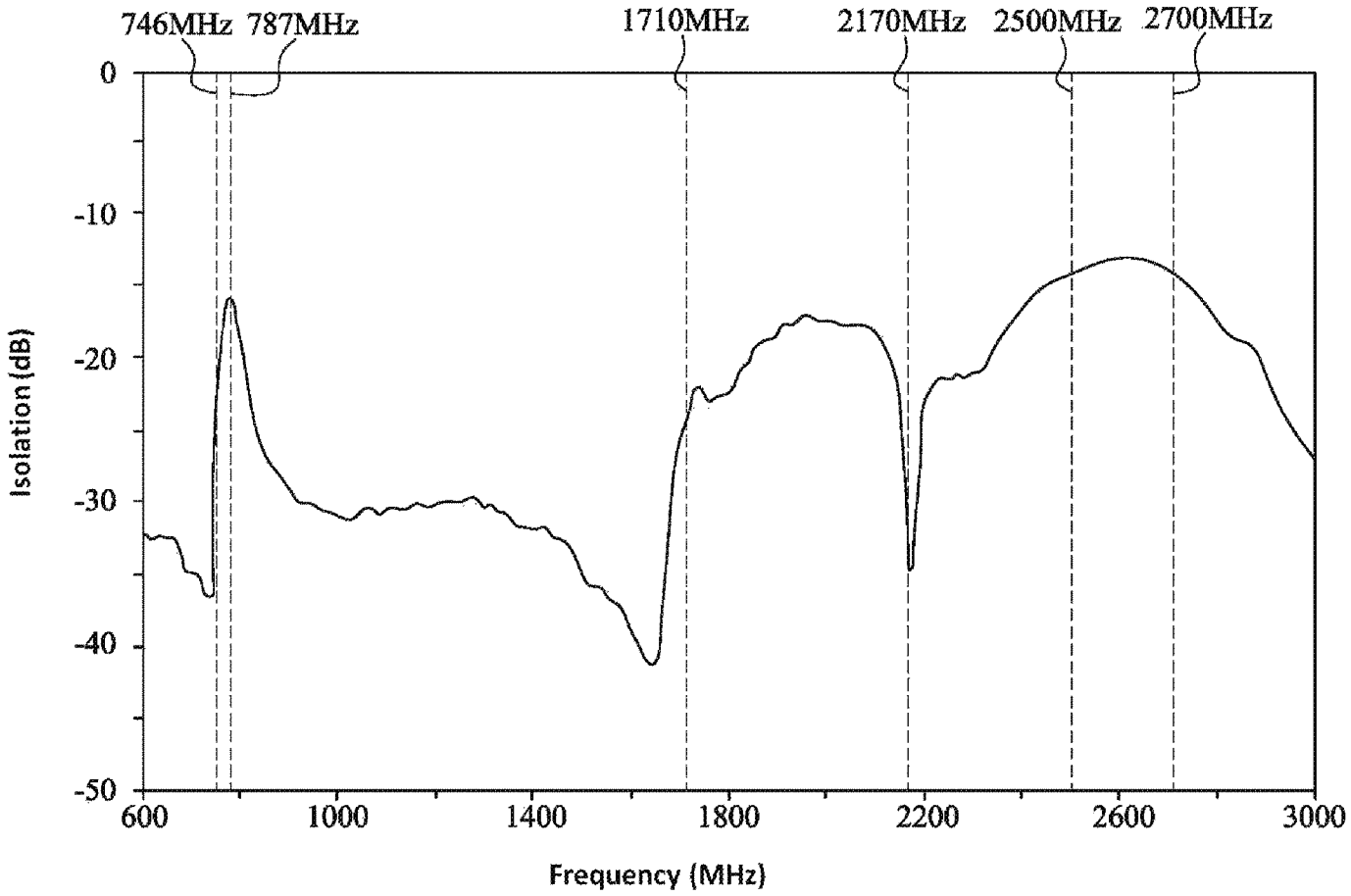
FIG. 5A is a plot of Isolation vs. Frequency for an antenna unit according to an embodiment of the present invention.

The isolation of two symmetrical mirrored antenna units 120 of the antenna system 100 is shown in FIG. 5A. FIG. 5A shows isolation vs. frequency of the two antenna units 120 according to an embodiment of the present invention. As seen in FIG. 5A, the isolation of the two antenna units 120 is less than −10 dB in low resonant frequency and less than −15 dB in high resonant frequency. It is obvious that the two antenna units 120 have the good isolation.

Figure 5B:
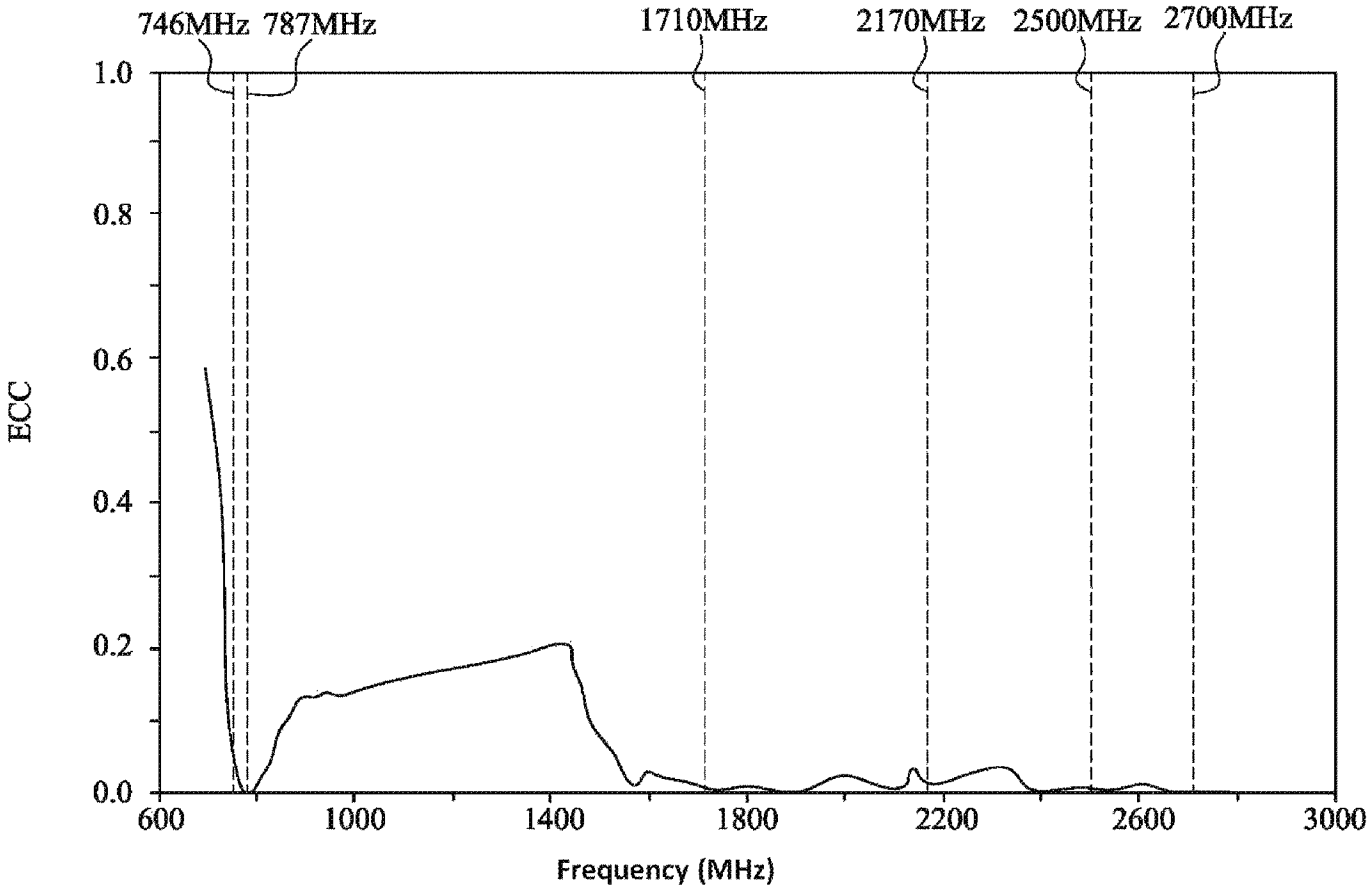
FIG. 5B is a plot of ECC vs. Frequency for an antenna unit according to an embodiment of the present invention.

Please refer to FIG. 5B. FIG. 5B shows envelope correlation coefficient (ECC) vs. frequency of the two antenna units 120 according to an embodiment of the present invention. As seen in FIG. 5B, the ECC of the two antenna units 120 of the antenna system 100 is less than 0.5 in the low resonant frequency, and less than 0.3 in the high resonant frequency.

Figure 6:
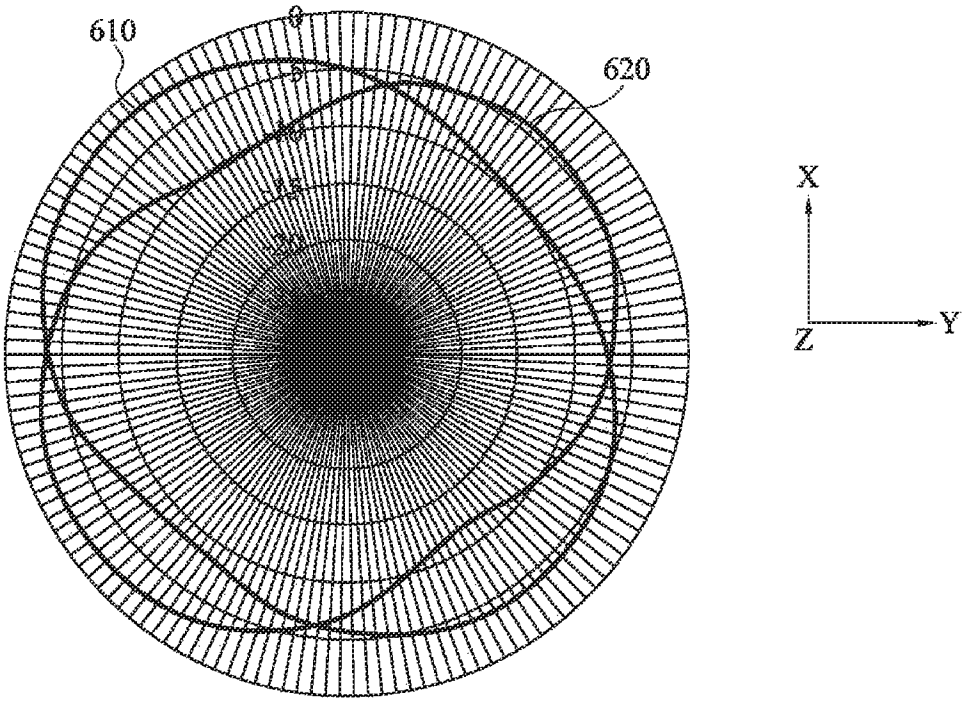
FIG. 6 is a schematic diagram of a radiation pattern of an antenna unit according to an embodiment of the present invention.

Please cross-refer to FIG. 6. FIG. 6 is a schematic diagram of a radiation pattern of the antenna system 100 in a low frequency (for example, 756 MHz) according to an embodiment of the present invention. In FIG. 6, a curve 610 represents a radiation pattern of the right-sided antenna unit 120 of the antenna system 100 in FIG. 1 while a curve 620 represents a radiation pattern of the left-sided antenna unit 120 of the antenna system 100 in FIG. 1. On the horizon plane (X-Y plane), the radiation patterns of the two antenna units 120 are orthogonal to each other, which reduces the interference between the two antenna units 120. Therefore, the antenna system 100 can achieve a smaller ECC.

As known in FIGS. 5A, 5B and 6, the two antenna units 120 of the antenna system 100 have a better performance in all aspects, such as isolation, ECC, and radiation pattern. Thus, the antenna system 100 of the present disclosure has a better quality of the signal reception/transmission on the wireless transmission rate.

Figure 7:
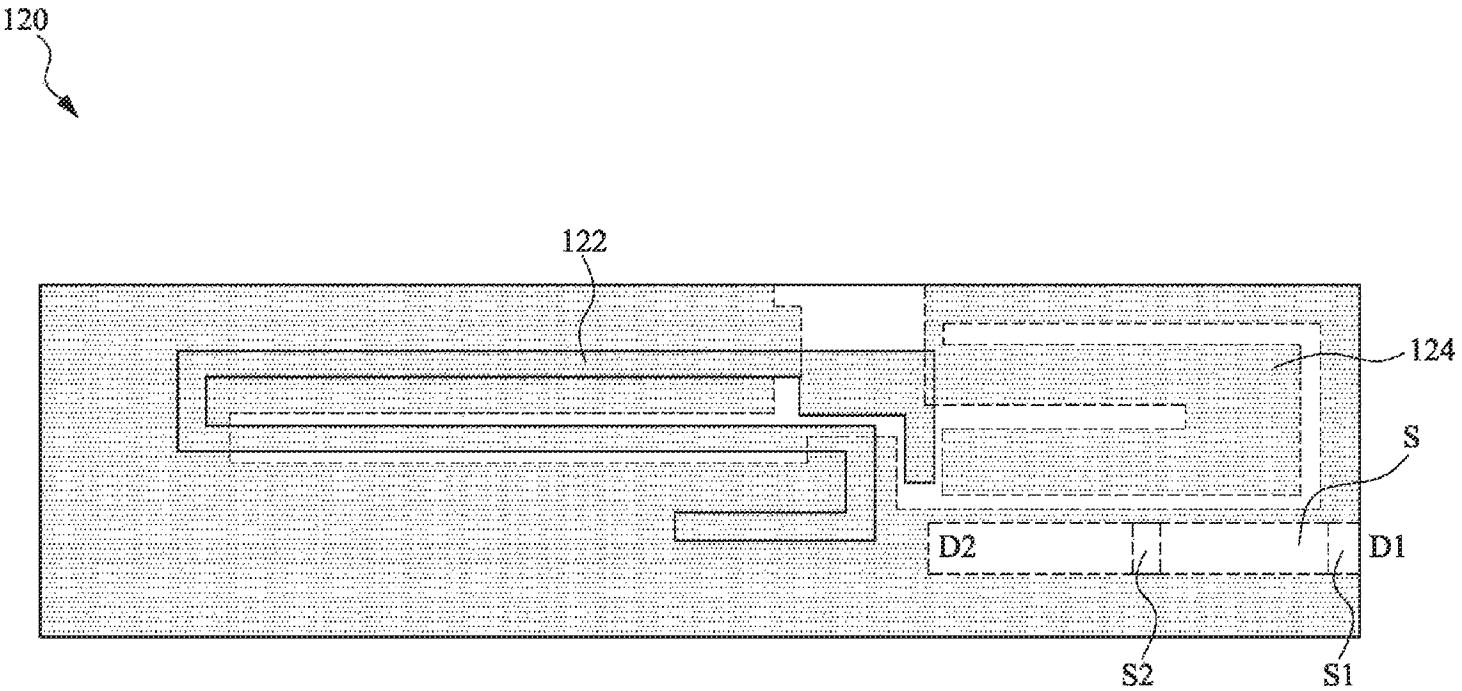
FIG. 7 is a side view of an antenna unit according to an embodiment of the present invention.

According to another embodiment of the present invention, a slot may be opened on the antenna units 120 of the antenna system 100, as shown in FIG. 7. FIG. 7 is a side view of the antenna unit 120 according to an embodiment of the present invention. A slot S from a point D1 to a point D2 is opened on the first current path 210 of the second antenna pattern 124 of the antenna unit 120, namely, on one side of the seventh metal part M7. This slot S shifts the low resonant frequency of the antenna unit 120 to a lower frequency. Two switches S1 and S2 are disposed at one end of the slot S and in the middle of the slot S, respectively. To be more specific, the switch S1 is located at the point D1, and the switch S2 is located in the middle of the point D1 and the point D2. The switches S1 and S2 may be, but not limited to, a transistor switch or any component with a switching function.

As mentioned above, the low resonant frequency is generated by the resonance of the overlapped projections of the first antenna pattern 122 and the gap B on the back side, and the overlapped projections of the first antenna pattern 122 and the first current path 210 of the second antenna pattern 124. Turning the switches S1 and S2 on and off can switch the grounding paths with different lengths, and further the low resonant frequency or the low resonant frequency band can be controlled. Insufficiency of the low resonant frequency band can be improved by the slot S, and the switches S1 and S2.

For example, the grounding path is shorter when the switches S1 and S2 are off. In this case, the low resonant frequency of the antenna unit 120 is about 700 MHz. When the switch S1 is off and the switch S2 is on, the low resonant frequency of the antenna unit 120 is about 800 MHz. When the switch S1 is on, the low resonant frequency of the antenna unit 120 is about 900 MHz. It is understood that the position and the number of the switches can be adjusted according to practical requirements, and not limited herein.

Figure 8:
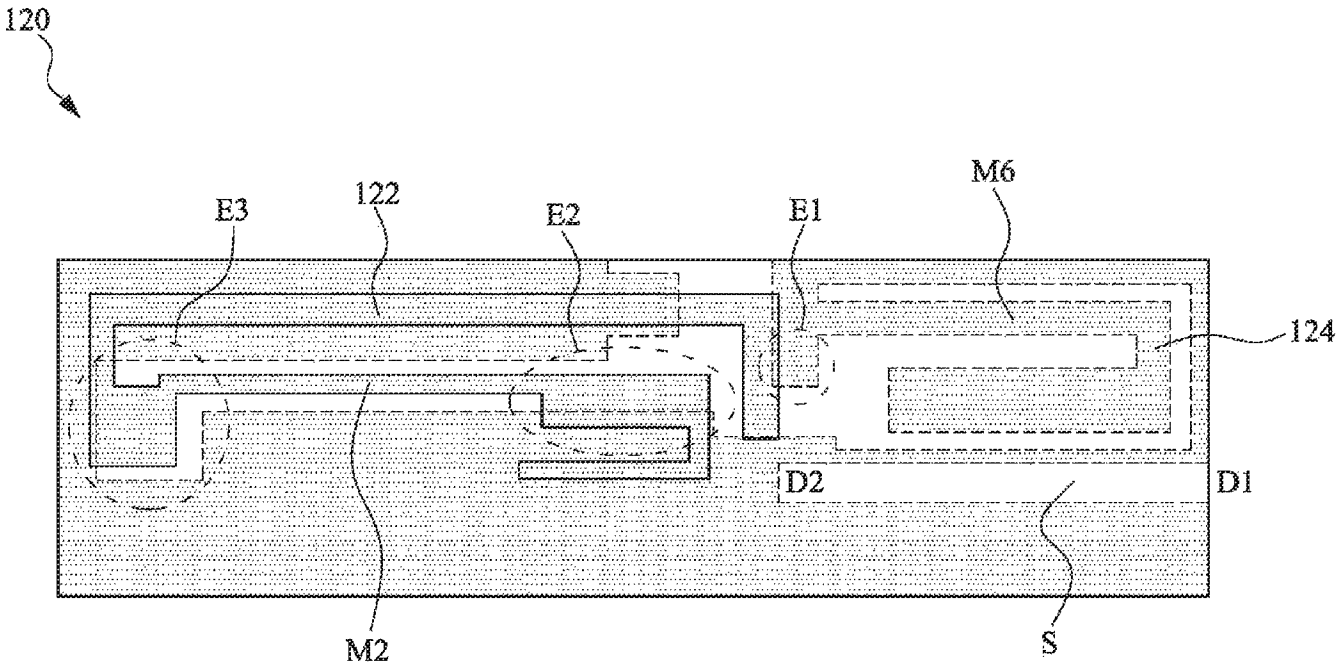
FIG. 8 is a side view of an antenna unit according to an embodiment of the present invention.

According to yet another embodiment of the present invention, the size of the antenna units 120 of the antenna system 100 can be further miniaturized, in order to meet the requirements for even smaller electronic devices. FIG. 8 is a side view of the antenna unit 120 according to an embodiment of the present invention. In FIG. 8, the antenna unit 120 has a dimension of d1 (L)×d4 (W)×d5 (H), for example, 65 mm×15 mm×0.8 mm and still possesses the same characterizations as the aforementioned antenna unit 120 does. Similar to the embodiment of FIG. 7, FIG. 8 shows that the first current path 210 of the second antenna pattern 124 of the antenna unit 120 has a slot S from the point D1 to the point D2, which shifts the low resonant frequency to a lower frequency.

As shown in FIG. 8, one end (left end) of the sixth metal part M6 of the second antenna pattern 124 has a protruding part after the antenna unit 120 is miniaturized. The protruding part has a projection overlapped with a projection of the antenna pattern 122 in the vertical direction (as marked by a circle E1). Each of the two opposite ends (the left end and the right end) of the second metal part M2 of the first antenna pattern 122 also has a protruding part. The projections of the second antenna pattern 124 and the protruding part on the right end in the vertical direction are partially overlapped (as marked by a circle E2). The projections of the second antenna pattern 124 and the protruding part on the left end in the vertical direction are partially overlapped (as marked by a circle E3) as well. By adjusting the overlapped area of the projections of the first antenna pattern 122 and the second antenna pattern 124 on the back side in the circles E1, E2 and E3 (i.e. adjusting a coupling level of the first antenna pattern 122 and the second antenna pattern 124 on the back side in the circles E1, E2 and E3), the high resonant frequency and impedance matching bandwidth can be controlled.

Figure 9:
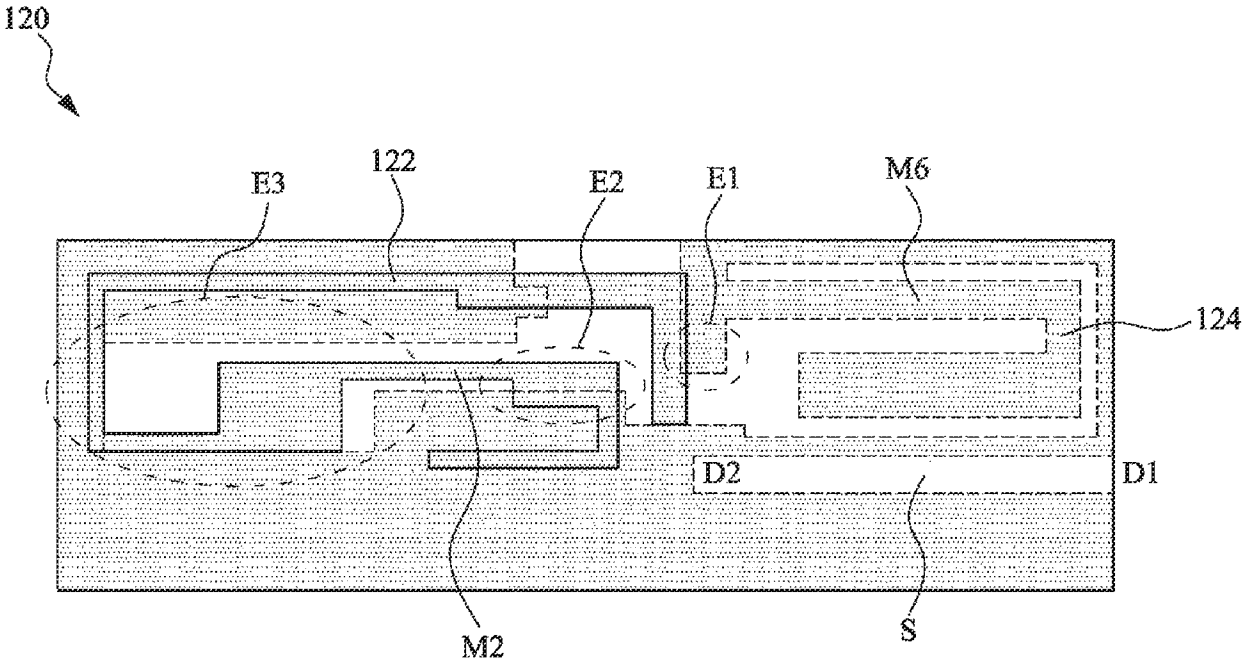
FIG. 9 is a side view of an antenna unit according to an embodiment of the present invention.

According to still yet another embodiment of the present invention, the antenna unit 120 of the antenna system 100 can be further miniaturized. For example, FIG. 9 is a side view of the antenna unit 120 according to an embodiment of the present invention. In FIG. 9, the antenna unit 120 has a dimension of d1 (L)×d4 (W)×d5 (H), for example, 60 mm×15 mm×0.8 mm and possesses the same characterization as the aforementioned antenna unit 120 does. Similar to the embodiment of FIG. 8, the second antenna pattern 124 of the antenna 120 in FIG. 9 also has a slot S from the point D1 to the point D2.

In this embodiment, one end (the left end) of the sixth metal part M6 of the second antenna pattern 124 also has a protruding part, the projection of which is partially overlapped with the projection of the first antenna pattern 122 in the vertical direction (as marked by a circle E1 in FIG. 9). One end (the right end) of the second metal part M2 of the first antenna pattern 122 has a protruding part, the projection of which is partially overlapped with the projection of the second antenna patter 124 in the vertical direction (as marked by a circle E2). The other end (the left end) of the second metal part M2 has a protruding bend, the projection of which is partially overlapped with the projection of the second antenna pattern 124 in the vertical direction (as marked by a circle E3). By adjusting the overlapped area of the projections of the first antenna pattern 122 and the second antenna pattern 124 on the back side in the vertical direction in the circles E1, E2 and E3, the high resonant frequency and impedance matching bandwidth can be controlled.

In the embodiments of FIGS. 8 and 9, the antenna system 100 composed of the two antenna units 120 still keeps isolation less than −8 dB as well as have a good quality for signal reception and transmission even though the antenna unit 120 is further miniaturized.

The embodiment of FIG. 7 is classified as a first type; the embodiment of FIG. 8 is classified as a second type; the embodiment of FIG. 9 is classified as a third type. The dimension of the antenna unit for each type is shown in a table 1 below:

TABLE 1

| | First Type | Second Type | Third Type |
|---|---|---|---|
| Antenna System 100 | 75 mm × 75 mm × 20 mm | 65 mm × 65 mm × 20 mm | 60 mm × 60 mm × 20 mm |
| Antenna Unit 120 | 75 mm × 15 mm × 0.8 mm | 65 mm × 15 mm × 0.8 mm | 60 mm × 15 mm × 0.8 mm |

A table 2 below shows parameters of the left-sided and the right-sided antennas 120 of the antenna system 100, for example, isolation, ECC, antenna gain, and etc.

TABLE 2

| | Frequency band | First Type | Second Type | Third Type |
|---|---|---|---|---|
| Isolation | 746 MHz~787 MHz | −15.80 | −8.49 | −8.42 |
| | 1710 MHz~2170 MHz | −17.03 | −11.11 | −10.48 |
| | 2500 MHz~2700 MHz | −13.01 | −11.69 | N/A |
| ECC | 746 MHz~787 MHz | 0.11 | 0.10 | 0.18 |
| | 1710 MHz~2170 MHz | 0.04 | 0.06 | 0.03 |
| | 2500 MHz~2700 MHz | 0.01 | 0.07 | N/A |

TABLE 2-continued

| | | Frequency band | First Type | Second Type | Third Type |
|---|---|---|---|---|---|
| Antenna Gain | Right-sided antenna unit | 746 MHz~787 MHz | −3.27~−7.52 | −3.30~−5.45 | −3.63~−4.81 |
| | | 1710 MHz~2170 MHz | −1.92~−5.47 | −1.53~−4.28 | −1.48~−5.05 |
| | | 2500 MHz~2700 MHz | −1.41~−1.72 | −2.38~−4.11 | N/A |
| | Left-sided antenna unit | 746 MHz~787 MHz | −4.23~−6.10 | −3.69~−6.00 | −4.81~−6.64 |
| | | 1710 MHz~2170 MHz | −2.19~−3.91 | −1.46~−4.22 | −1.45~−3.23 |
| | | 2500 MHz~2700 MHz | −1.46~−1.88 | −2.60~−4.83 | N/A |

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An antenna system comprising:

a system ground; and two antenna units, individually disposed on two opposite sides of the system ground and symmetrically mirrored with each other, each antenna unit comprising:

a circuit board;

a first antenna pattern, disposed at one side of the circuit board, the first antenna pattern comprising a first metal part, a second metal part, a third metal part, a first bend and a second bend, the first metal part connected with one end of the second metal part via the first bend and the other end of the second metal part connected with the third metal part, to generate a first high resonant frequency; and a second antenna pattern, disposed at the other side of the circuit board, the first antenna pattern resonating with part of the second antenna pattern to generate a low resonant frequency.

2. The antenna system of claim 1, wherein the first antenna patterns of the two antenna units are symmetrically mirrored with each other with respect to a center line of the antenna system, and the second antenna patterns of the two antenna units are symmetrically mirrored with each other with respect to the center line of the antenna system.

3. The antenna system of claim 1, wherein the first metal part has a first end and a second end opposite the first end, and a width of the first end is greater than a width of the second end.

4. The antenna system of claim 1, wherein projections of the first metal part and the second antenna pattern in a direction perpendicular to the circuit board have an overlap, and the size of the overlap is associated with an impedance matching bandwidth of the low resonant frequency.

5. The antenna system of claim 1, wherein the second antenna pattern has a gap, and the gap divides the second antenna pattern into a first current path and a second current path, and the other side of the circuit board faces the system ground.

6. The antenna system of claim 5, wherein the second antenna pattern on the first current path comprises a forth metal part, a fifth metal part, a sixth metal part and a seventh metal part, and the forth metal part is perpendicular to the fifth metal part, and the fifth metal part, the sixth metal part and the seventh metal part are aligned in parallel.

7. The antenna system of claim 5, wherein a width of the gap is associated with the low resonant frequency.

8. The antenna system of claim 5, wherein the second antenna pattern on the second current path comprises a eighth metal part, a ninth metal part and a tenth metal part; the eighth metal part is perpendicular to the ninth metal part; the tenth metal part is connected to the ninth metal part; a width of the tenth metal part is less than a width of the ninth metal part.

9. The antenna system of claim 8, wherein the first antenna pattern resonates with the second current path and the gap to generate a second high resonant frequency, and the width of the tenth metal part is associated with an impedance matching bandwidth of the second high resonant frequency.

10. The antenna system of claim 5, wherein the first antenna pattern resonates with the first current path and the gap to generate a third high resonate frequency.

11. The antenna system of claim 5, wherein the first current path comprises a slot at which a plurality of switches are disposed, and the first current path switches different grounding routes and controls the low resonant frequency via the switches.

12. The antenna system of claim 5, wherein the first antenna pattern resonates with the second current path to generate a forth high resonate frequency.

13. The antenna system of claim 12, wherein the second antenna pattern further comprises a slit; projections of the first antenna pattern and the slit have an overlap in a direction perpendicular to the circuit board have an overlap, and the size of the slit is associated with the forth high resonant frequency.

14. The antenna system of claim 1, wherein radiation fields of the two antenna units are orthogonal to each other.

* * * * *